US011772862B2

(12) United States Patent
Sterling

(10) Patent No.: US 11,772,862 B2
(45) Date of Patent: Oct. 3, 2023

(54) CAP FOR VENTING A CONTAINER

(71) Applicant: Henkel AG & Co. KGaA, Duesseldorf (DE)

(72) Inventor: Daniel Peter Sterling, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 17/702,358

(22) Filed: Mar. 23, 2022

(65) Prior Publication Data

US 2022/0306360 A1 Sep. 29, 2022

Related U.S. Application Data

(60) Provisional application No. 63/166,657, filed on Mar. 26, 2021.

(51) Int. Cl.
*B65D 51/16* (2006.01)
*B67D 3/00* (2006.01)

(52) U.S. Cl.
CPC ..... *B65D 51/1683* (2013.01); *B67D 3/0061* (2013.01)

(58) Field of Classification Search
CPC ..... B65D 51/1683; B67D 3/0061
USPC ..... 222/80–89
See application file for complete search history.

(56) References Cited

U.S. PATENT DOCUMENTS 938,644 A * 11/1909 Curtis ..... 222/91
4,888,008 A * 12/1989 D'Alo ..... A61J 1/1487 604/411
6,390,335 B1 * 5/2002 Lawson ..... B67B 7/26 222/82
2007/0032775 A1 * 2/2007 Niedospial ..... A61J 1/2096 604/415
2020/0247603 A1 * 8/2020 Cwiok ..... B05B 7/0018
2020/0247604 A1 * 8/2020 Cwiok ..... B05B 7/0018
2022/0306360 A1 * 9/2022 Sterling ..... B67D 3/0061
2022/0306361 A1 * 9/2022 Bull ..... B65D 25/40
2022/0306447 A1 * 9/2022 Krystinik ..... B67B 7/24

* cited by examiner

*Primary Examiner* — Paul R Durand
*Assistant Examiner* — Michael J. Melaragno
(74) *Attorney, Agent, or Firm* — STERNE, KESSLER, GOLDSTEIN & FOX P.L.L.C.

(57) ABSTRACT

A container for dispensing a liquid that includes a body, a closure, and an overcap. The body includes an interior storage volume, a neck finish on a first wall of the body, and a protrusion on a second wall of the body. The neck finish defined outlet through the first wall for dispensing the liquid. The closure for sealing the outlet and coupled to the neck finish. The overcap is removably coupled to the closure and includes a first end including a recess configured to receive a portion of the closure when the overcap is coupled to the closure and a second end including a shield defining a shield recess and a piercer. The shield is configured is configured to at least partially surround the protrusion of the body such that the piercer pierces the protrusion to create a vent opening when the shield at least partially surrounds the protrusion.

20 Claims, 13 Drawing Sheets

CAP FOR VENTING A CONTAINER

CROSS-REFERENCE TO RELATED APPLICATION

This application claims the benefit of U.S. Provisional Application No. 63/166,657, filed Mar. 26, 2021, which is incorporated herein in its entirety by reference thereto.

BACKGROUND

The present disclosure relates to devices and methods for venting a container, more specifically to a cap that includes a piercer for piercing a body of the container to vent the interior volume of the container body.

BRIEF SUMMARY

Some embodiments disclosed herein are directed to a container for dispensing a liquid, the container including a body having an interior storage volume, a neck finish disposed on a first wall of the body, the neck finish defining an outlet through the first wall for dispensing the liquid, and a protrusion formed on a second wall of the body. In some embodiments, the container includes a closure for sealing the outlet, the closure coupled to the neck finish. In some embodiments, an overcap removably coupled to the closure includes a first end having a recess configured to receive a portion of the closure when the overcap is coupled to the closure. In some embodiments, a second end opposite the first end includes a shield defining a shield recess and a piercer disposed within the shield recess. In some embodiments, the shield is configured to at least partially surround the protrusion of the body such that the piercer pierces the protrusion to create a vent opening when the shield at least partially surrounds to protrusion.

In some embodiments, the closure is a dispenser that includes a valve, the dispenser configured to dispense the liquid.

In some embodiments, the container further comprises a recess in the second wall of the body, the recess defining a channel and the protrusion.

In some embodiments, the neck finish is disposed proximate to a bottom of the body, and wherein the recess is disposed proximate to a top of the body.

In some embodiments, the vent opening has a diameter of about 2.0 mm to about 10 mm.

In some embodiments, the overcap is integral with the closure.

In some embodiments, the overcap is configured to couple to the closure by an interference fit.

In some embodiments, the first end of the cap has a first diameter and the second end of the cap has a second diameter that is smaller than the first diameter.

In some embodiments, the first diameter is between about 40 mm and about 50 mm and the second diameter is between about 10 mm and about 15 mm.

In some embodiments, the piercer has a pointed end. In some embodiments, the piercer has a conical shape.

In some embodiments, the shield has a first height and the piercer has a second height that is less than the first height.

In some embodiments, the piercer is configured to pierce the protrusion when the shield at least partially surrounds the protrusion and a force is applied to the overcap in a direction normal to the second wall.

In some embodiments, the interior storage volume has a capacity of at 0.2 liters to 4 liters.

In some embodiments, the container is a blow molded container.

In some embodiments, the container further includes the liquid disposed in the interior storage volume.

Some embodiments disclosed herein are directed to an overcap for venting a container for dispensing a liquid, the overcap includes: a first end including an outer wall defining a recess, the overcap configured to removably couple to the container at a neck of the container, the neck being disposed at least partially within the recess when the overcap is coupled to the container; a second end opposite the first end, the second end including a shield defining a shield recess, the shield being configured for insertion into a channel of the container; a piercer disposed within the shield recess, the piercer having a height less than a height of the shield, wherein the piercer is configured to pierce the container when the shield is inserted into the channel to create a vent opening in the container.

In some embodiments, the first end is configured to couple to the neck by an interference fit.

In some embodiments, the piercer has a conical shape.

In some embodiments, the shield has a first height and the piercer has a second height that is less than the first height.

BRIEF DESCRIPTION OF THE FIGURES

The accompanying drawings, which are incorporated herein and form a part of the specification, illustrate the embodiments and, together with the description, further serve to explain the principles of the embodiments and to enable a person skilled in the relevant art(s) to make and use the embodiments.

DETAILED DESCRIPTION

Figure 1:
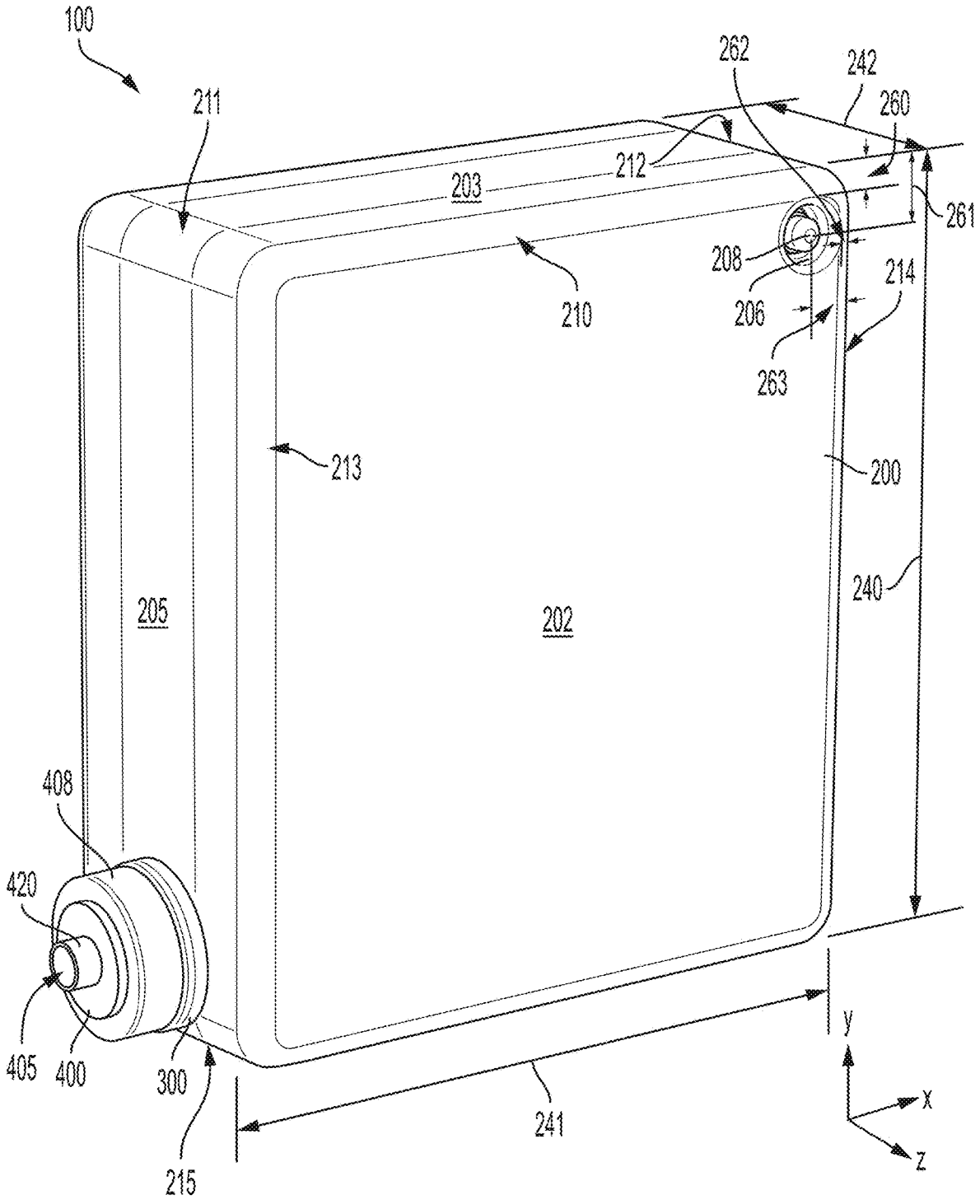
FIG. 1 is a perspective view of a container according to some embodiments.

Larger dispensing containers, for example containers for storing liquid, are often provided with a dispensing closure (e.g., a tap-style closure) for convenient dispensing of the contents without the need to lift and pour from the bottle. So that all of the contents may be dispensed, the tap is typically located on a dispensing neck at or near the bottom of the container (when in the in-use/dispensing orientation). These containers often have a path for air to re-enter the container and replace the volume of the displaced liquid. Otherwise, the container may deform due to internal vacuum or negative air pressure in the container. And the flow of liquid may slow or cease as the amount of vacuum equalizes with the head pressure of the liquid.

To compensate for the pressure change as the liquid exits the container, some containers use a second opening at or near the top of the container to vent the container. Some containers use a second neck and second closure located opposite the dispensing neck and closure on the upper portion of the bottle when oriented for dispensing. The second closure is typically removed or loosened when dispensing to allow the container to vent. But this design may be more difficult to manufacture and use more plastic than a similar container with only one neck. And the addition of a second opening increases the chance of leaking during manufacturing, distribution before use, and also while using the product. Further, the second neck is typically large enough to allow refilling of the container, which increases the risk of the container being reused with an incompatible and/or counterfeit liquid. And it is not desirable or attractive to have the venting location, particularly in the form of a second neck and closure, facing the user when in the dispensing orientation. A second neck also requires a large amount of headspace in the container so that the container does not leak when it is vented when full.

Other containers require a user to pierce the container, for example using a sharp tool such as a knife. Often this piercing is done in a prescribed location molded or embossed into the container. This can create inconsistent venting from container to container and require using extra tools or sharp objects. Also, asking the user to find an appropriate tool (knife, scissors, etc.) to puncture a hole in the upper part of the bottle is crude and inconvenient. There is also a risk that the container will leak if the user pierces the container in the wrong location (e.g., below the headspace of the container).

Therefore, there is a need for a container that includes a vent in a location (e.g., on the opposite corner (upper rear) from the dispensing closure and neck (lower front)) that is desirable for aesthetics and consumer convenience. And there is a need for a container that can be vented in a self-contained way. For example, there is a need for a container that can be vented to create an air pathway using only the components that are distributed with the container, requiring no additional tools.

Embodiments described herein overcome these and other challenges by providing—among other benefits—a single-neck container that can be vented without any additional tools. The present disclosure describes methods and apparatuses for venting a container (e.g., by piercing the container). As shown throughout the figures, container 100 can include body 200, closure 300, and an overcap (e.g., overcap 400 or 500). As described in more detail below, overcap 400 or 500 can include a first end that couples to and covers at least a portion of closure 300 and a second end that includes a piercer for piercing the body 200, for example at protrusion 208 on body 200. As disclosed in embodiments, body 200 can be vented, for example, by simply removing overcap 400 or 500 from closure 300, aligning overcap 400 or 500 with a channel around the protrusion such that the piercer aligns with the protrusion and pierces the protrusion when a user applies force to overcap 400 or 500.

Figure 2:
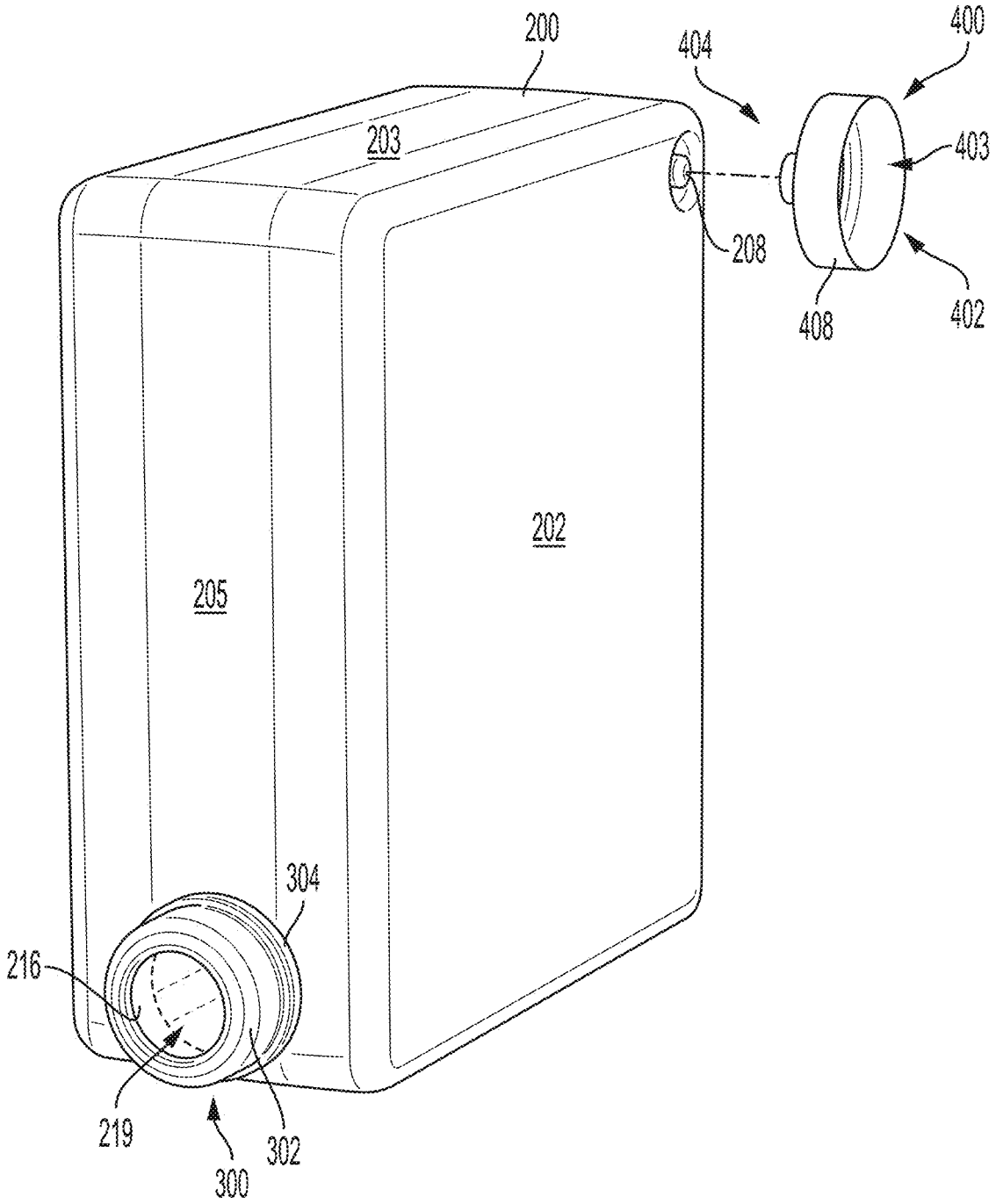
FIG. 2 is a perspective view of the container of FIG. 1 with the overcap removed.

As shown in FIG. 1, for example, in some embodiments, container 100 can include closure 300 that seals body 200. In some embodiments, closure 300 can be coupled to neck 216 of body 200, as shown in FIGS. 1 and 2. In some embodiments, closure 300 can be a closure that seals body 200 and is removed before use. Closure 300 can be a seal that is broken prior to use. In some embodiments, closure 300 can be a dispenser (e.g., a tap-style dispenser), as shown for example in FIG. 4. In some embodiments, overcap 400 or 500 can be an overcap that is coupled to closure 300 and at least partially covers closure 300, as shown, for example, in FIGS. 1, 5, and 6. In some embodiments, overcap 400 or 500 can couple to closure 300, for example, by an interference fit or snap fit.

In some embodiments, overcap 400 or 500 can be removably coupled to closure 300. For example, overcap 400 can be removed as shown in FIG. 2, exposing closure 300 and outlet 219. When removed from closure 300, overcap 400 or 500 can be used to create vent opening 220 in body 200, for example, by piercing protrusion 208 on body 200 to. Once vent opening 220 is created, body 200 can vent as liquid is dispensed from body 200 (e.g., from a tap-style dispenser) to accommodate the change in pressure due to displaced liquid.

In some embodiments, container 100 can include body 200 for holding a liquid. The liquid can be any liquid suitable for dispensing from a container. For example, in some embodiments, the liquid can include detergents, soaps, or cleaning products that are stored in container 100 or used to refill container 100. In some embodiments, the liquid includes one or more of laundry detergent, fabric softener, hand soap, shampoo, conditioner, body wash, face soap, lotion, dish soap, hair products (e.g., gel), counter cleaners, toilet cleaners, or bath cleaners. In some embodiments, the liquid is a detergent (e.g., laundry detergent). In some embodiments, the liquid is a fabric softener. Other suitable liquids can be stored in and dispensed from body 200.

In some embodiments, container 100 is a gravity-fed container, meaning liquid inside the container flows out of the container by the force of gravity. In some embodiments, container 100 can be stored, for example, on a counter, shelf, or other flat surface and liquid in the container can be dispensed directly from the container (e.g., into a dose cup, a cap, or a person's hand). In some embodiments, container 100 can be mounted on a substantially vertical surface (e.g., walls or sides of cabinets, sides of appliances, etc.).

As shown in FIGS. 1, 2 and 4-7B, for example, body 200 can include side walls 202; top wall 203; back wall 204; front wall 205; channel 206; protrusion 208; edges 210, 211, 212, 213, 214, and 215; and interior volume 218.

Figure 8:
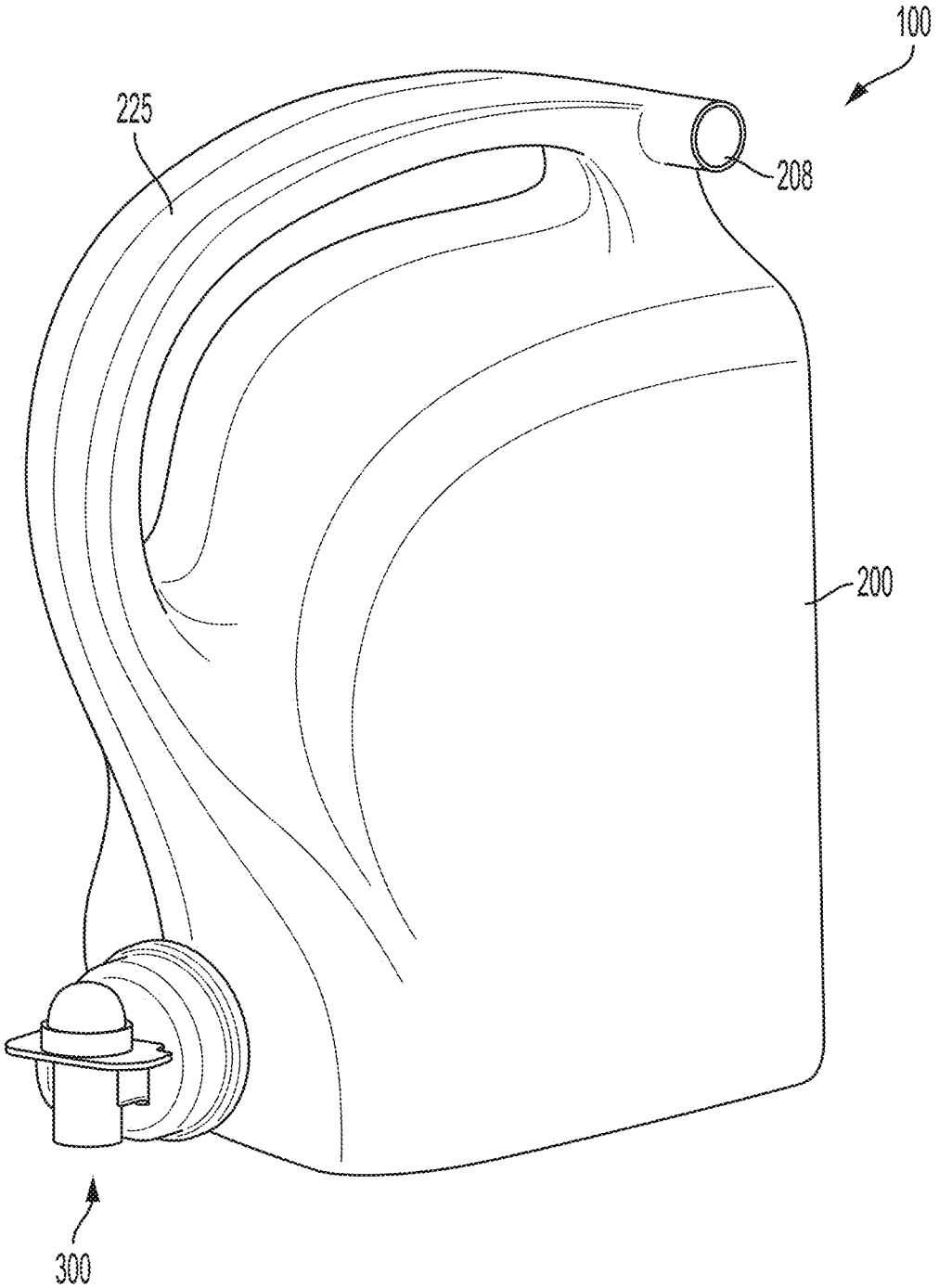
FIG. 8 shows a container according to some embodiments.
Figure 9:
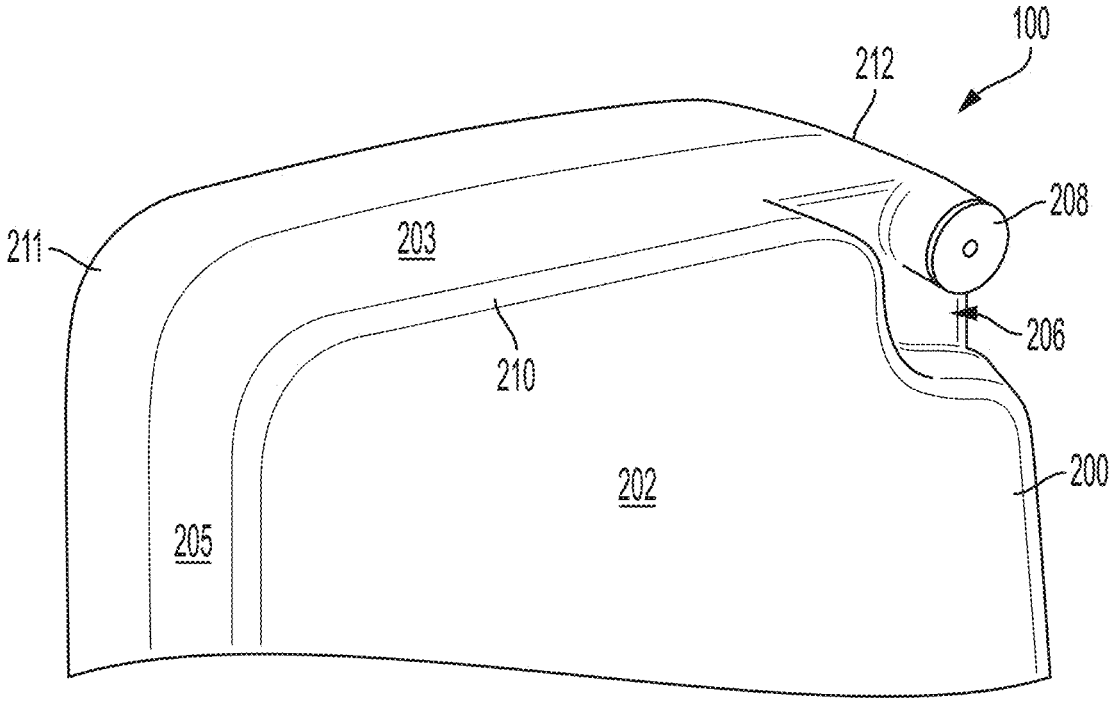
FIG. 9 shows a container according to some embodiments.

As shown in FIG. 1, for example, body 200 can have a height 240 in the Y-direction, a length 241 in the X-direction, and a width 242 in the Z-direction. In some embodiments, height 240 can be between about 100 mm to about 400 mm (e.g., about 150 mm to about 300 mm or about 200 mm to about 250 mm). In some embodiments, height 240 is about 225 mm. In some embodiments, length 241 can be between about 100 mm to about 400 mm (e.g., about 125 mm to about 300 mm or about 150 mm to about 250 mm). In some embodiments, length 241 is about 200 mm. In some embodiments, width 242 is about 50 mm to about 200 mm (e.g., about 60 mm to about 150 mm or about 80 mm to about 100 mm). In some embodiments, width 242 is about 90 mm. Body 200 is shown as a substantially cuboid shape for convenience throughout the figures. However, it is to be understood that body 200 can take various shapes, including non-regular shapes or organic shapes with curved sides edges (e.g., as shown in FIGS. 8 and 9). Further, it is to be understood that the dimensions described above may not be the dimensions across all of body 200. For example, body 200 can have a height equal to height 240 at one point along a cross-section of body 200, and a height different than height 240 at another point along a cross-section of body 200.

In some embodiments, body 200 of container 100 can include interior volume 218 defined in part by outer walls of body 200 (e.g., bottom wall 201, side walls 202, top wall 203, back wall 204, or front wall 205). In some embodiments, interior volume 218 can have a volume of about 0.2 L to about 8 L (e.g., about 0.2 L to about 2 L, about 1 L to about 6 L, or about 3 L to about 5 L). In some embodiments, interior volume 218 has a volume of about 0.2 L to about 2 L. In some embodiments, interior volume 218 has a volume of about 2 L to about 4 L. In some embodiments, interior volume 218 has a volume of at least 2 L. In some embodiments, interior volume 218 has a volume of about 4 L. The container can be filled with a liquid. In some embodiments, the liquid is disposed in interior volume 218. The capacity of liquid in the container can be less than the total volume of interior volume 218. The remaining volume (i.e., the headspace) can be air at atmospheric pressure.

In some embodiments, body 200 can include a recess that defines channel 206 and protrusion 208. One or more channel 206 and protrusion 208 can be formed in the walls, including side walls 202, top wall 203, back wall 204, and/or front wall 205. In some embodiments, channel 206 and protrusion 208 are formed in side wall 202. In some embodiments, channel 206 can be annular. In some embodiments, channel 206 can be an incomplete circumference such that the uppermost diameter of the protrusion wall is tangent top wall 203 of body 200. For example, as shown in FIG. 9, in some embodiments, channel 206 can extend only partially around protrusion 208 and the uppermost portion of protrusion 208 is tangent top wall 203.

In some embodiments, protrusion 208 can be positioned close to top edge 210 to minimize headspace in body 200. The protrusion 208 and resulting venting opening 220 can be positioned high enough to nearly eliminate headspace in the bottle, thereby reducing unneeded plastic and wasted space. For example, when at capacity, the volume of the headspace can be less than about 10% (e.g., less than about 7%, less than about 5%, or less than about 3%) of the total volume of the container. In some embodiments, the volume of the headspace is less than about 7% of the total volume of the container.

Figure 7A:
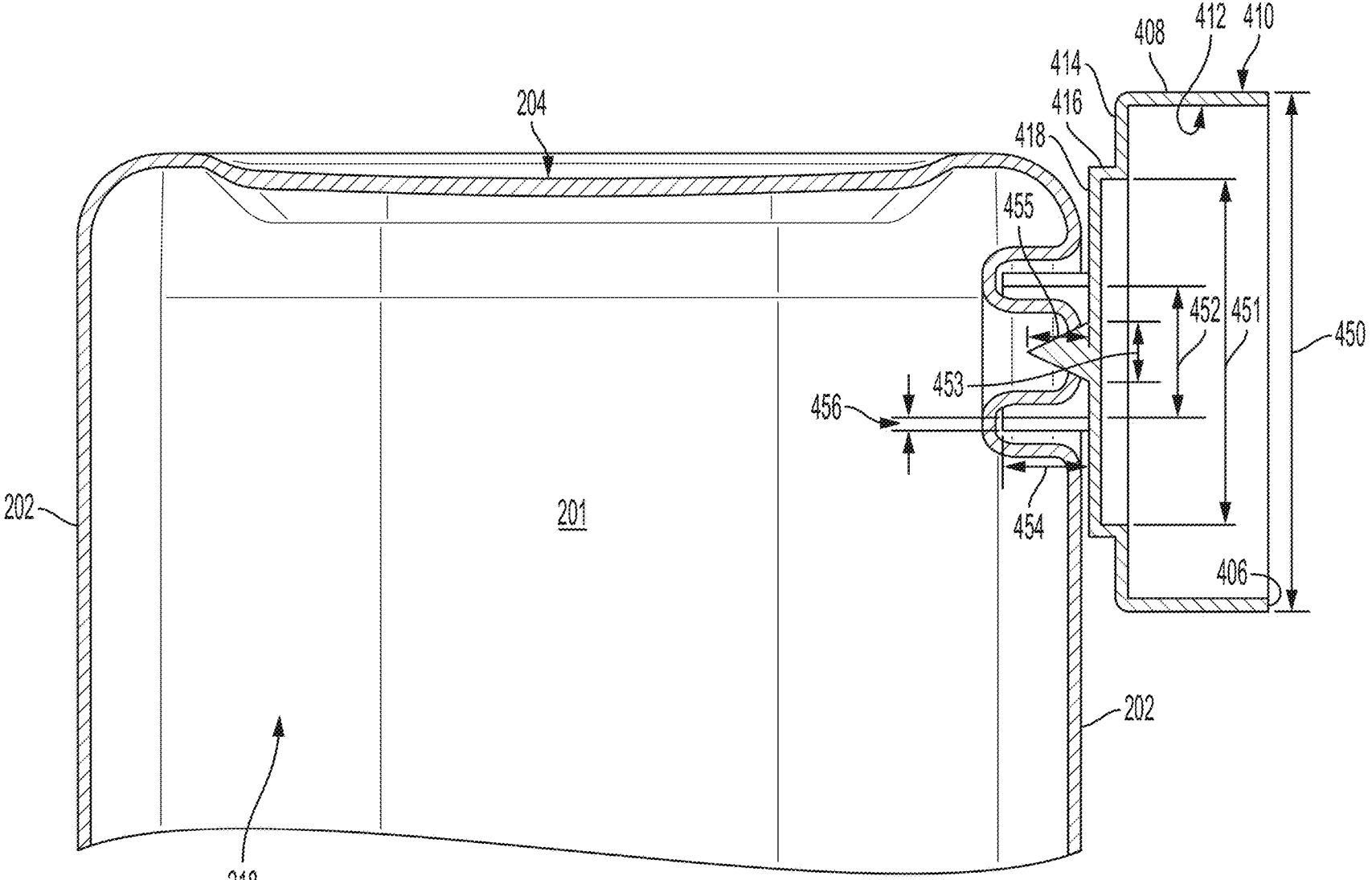
FIG. 7A shows a cross-section of the container of FIG. 4 taken along plane 7-7.
Figure 7B:
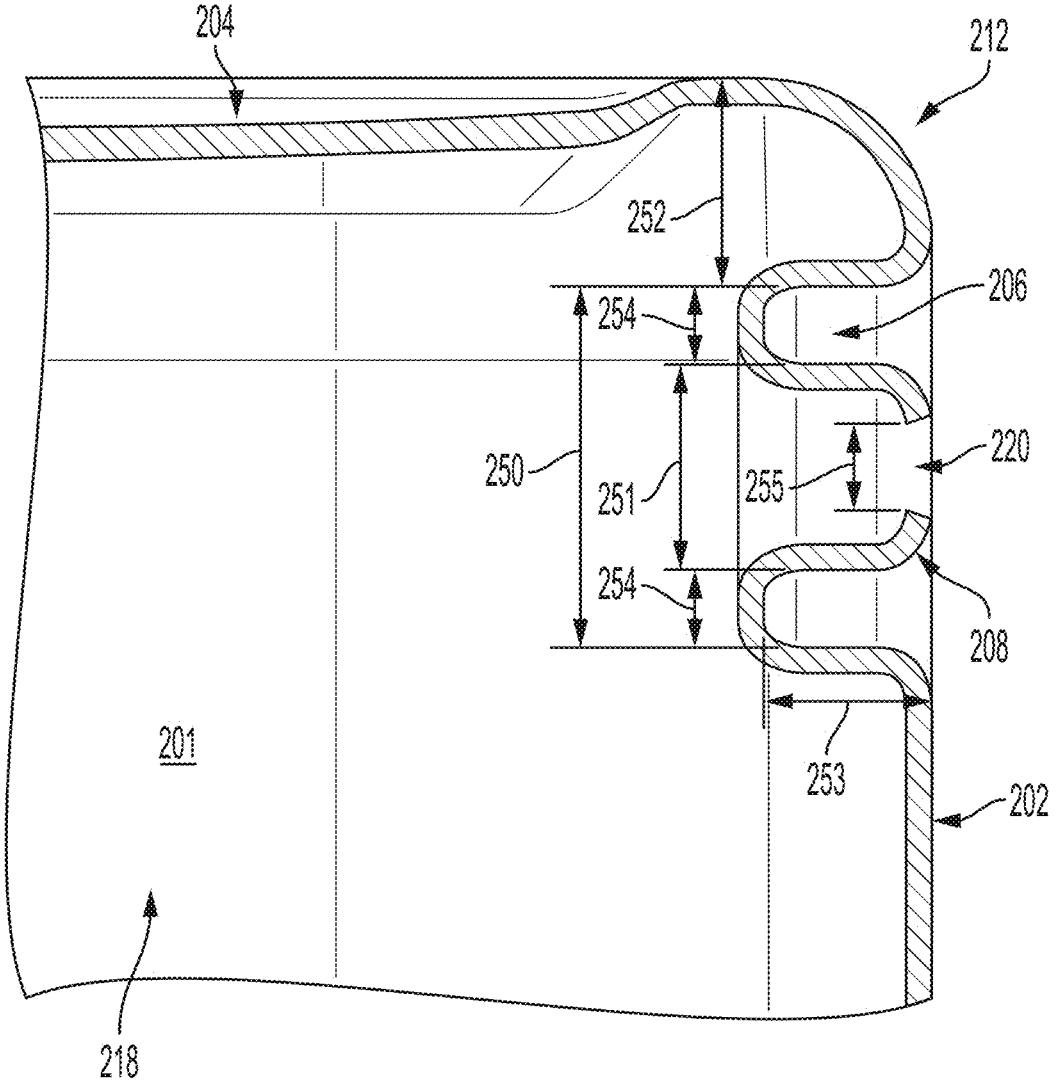
FIG. 7B shows the cross-section of FIG. 7A with the overcap removed.

In some embodiments, as shown in FIGS. 7A and 7B, for example, protrusion 208 can be defined by channel 206. In some embodiments, body 200 does not include channel 206. In some embodiments, protrusion 208 can project directly from a surface of body 200 (e.g., from one of walls 202, 203, 204, 205 or from one of edges 210, 211, or 212). In some embodiments, as shown in FIG. 8, body 200 does not include channel 206 and protrusion 208 can extend from a handle (e.g., handle 225).

In some embodiments, body 200 includes channel 206 and channel 206 can have outer diameter 250 and inner diameter 251. In some embodiments, outer diameter 250 can be about 10 mm to about 25 mm (e.g., about 15 mm to about 20 mm). In some embodiments, outer diameter 250 is about 16 mm. In some embodiments, inner diameter 251 can be about 5 mm to about 15 mm (e.g., about 7 mm to about 12 mm). In some embodiments, inner diameter 251 is about 9 mm. As shown in FIG. 1, channel 206 can be positioned such channel 206 is a distance 260 from edge 210 and a distance 262 from edge 214. In some embodiments, distance 260 and 262 are each about 1 mm to about 10 mm from the edge 210 and edge 214. Distance 260 can be about 1 mm to about 10 mm (e.g., about 4 mm to about 8 mm) from edge 210. In some embodiments, distance 260 can be about 6 mm from edge 210. In some embodiments, distance 262 can be about 1 mm to about 10 mm (e.g., about 4 mm to about 8 mm) from edge 214. In some embodiments, distance 262 can be about 6 mm from edge 214.

In some embodiments, channel 206 can have channel depth 253 and channel width 254. In some embodiments, channel depth 253 can be greater than a height 454 of shield 420 on overcap 400 or 500. In some embodiments, channel depth 253 can be equal to a height 454 of shield 420. In some embodiments, channel depth 253 can be about 5 mm to about 15 mm (e.g., about 6 mm to about 10 mm). In some embodiments, channel depth 253 is about 7.5 mm. In some embodiments, channel width 254 can be greater than a thickness 456 of a shield on the over cap (e.g., shield 420 or 520) to accommodate the shield of overcap 400 or 500 in channel 206. In some embodiments, channel width 254 can be about 2 mm to about 5 mm (e.g., about 3 mm to about 4 mm). In some embodiments, channel width 254 is about 3.5 mm.

In some embodiments, the geometry of channel 206 and protrusion 208 can cause the wall thickness of protrusion 208 to be thinner than the wall thickness of other walls (e.g., side walls 202, top wall 203, back wall 204, and front wall 205) due to the stretching of the material during production (e.g., during blow molding). In some embodiments, side walls (e.g., circumferential surface) of protrusion 208 can be ribbed or corrugated. Ribbing or corrugation can increase rigidity in the direction of piercing such that the force of piercer 428 can be concentrated at the point where piercer 428 creates vent opening 220. The wall thickness of walls of container 100 (e.g., side walls 202, top wall 203, back wall 204, and front wall 205) can be between about 0.25 mm and about 1.5 mm (e.g., about 0.08 mm to about 1.3 mm). In some embodiments, the wall thickness of walls of container 100 (e.g., side walls 202, top wall 203, back wall 204, and front wall 205) is about 1.15 mm. The wall thickness of protrusion 208 can be between about 0.5 mm and about 1 mm (e.g., about 0.6 mm to about 0.8 mm). In some embodiments, container 100 is thinnest at protrusion 208.

In some embodiments, protrusion 208 and, optionally, channel 206 can be positioned proximate to or along a top edge of body 200 (e.g., edges 210, 211, or 212). In some embodiments, protrusion 208 and, optionally, channel 206 can be positioned at any point on the sides of body 200 (e.g., side walls 202, back wall 204, or front wall 205) and proximate to a top edge of body 200 (e.g., edges 210, 211, or 212). In some embodiments, channel 206 and protrusion 208 can be positioned in top wall 203. In some embodiments, channel 206 and protrusion 208 are positioned, as shown in FIG. 1, in side wall 202 proximate to edge 210 and edge 214. In some embodiments, side wall 202 is disposed proximate to edge 210 to minimize headspace when the container is filled with liquid. For example, channel 206 and protrusion 208 can be disposed within the top one-third of the body (e.g., the top one-quarter or the top one-tenth). The center of protrusion 208 can be positioned a distance 261 from edge 210 and a distance 263 from edge 214. In some embodiments, distance 261 is equal to the inner diameter of protrusion 208 (e.g., diameter 251). In some embodiments, channel 206 and protrusion 208 can be positioned such that distance 261 and 263 are each about 6 mm to about 25 mm from the edge 210 and edge 214. Distance 261 can be about 6 mm to about 25 mm (e.g., about 10 mm to about 20 mm) from edge 210. In some embodiments, distance 261 can be about 18 mm from edge 210. In some embodiments, distance 263 can be about 6 mm to about 25 mm (e.g., about 10 mm to about 20 mm) from edge 214. In some embodiments, distance 263 can be about 18 mm from edge 214. In some embodiments, the center of protrusion 208 is equidistant from each of edge 210 and edge 214. In some embodiments, distance 261 and distance 263 are each about 18 mm. Protrusion 208 can be defined by channel 206 such that dimensions of protrusion 208 correspond to dimensions of channel 206. In some embodiments, protrusion 208 can have a diameter corresponding to inner diameter 251 and a height corresponding to channel depth 253.

Figure 4:
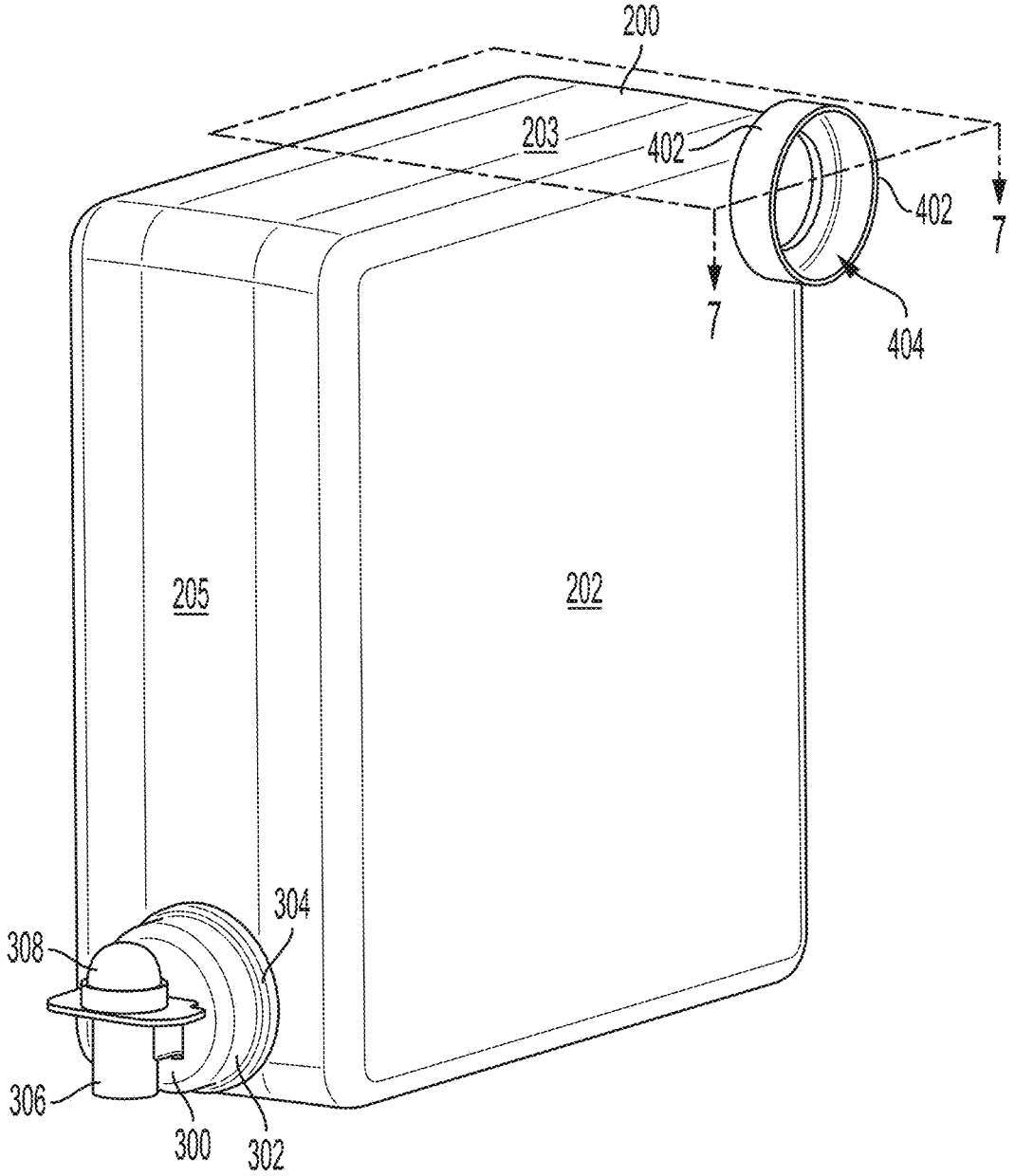
FIG. 4 shows a perspective view of a container according to some embodiments with an overcap in a position to pierce a body of the container.

In some embodiments, container 100 can include closure 300 that seals outlet 219. Closure 300 can couple to body 200 at neck 216. Various closures can be used to seal outlet 219. Example closures are shown in FIGS. 1, 2, and 4. For example, in some embodiments, as shown in FIG. 2 closure 300 can include a seal (e.g., seal 301) that covers and seals outlet 219 prior to use. The seal can be broken or removed prior to use to expose a flow path through outlet 219. In some embodiments, closure 300 can include a frangible seal that seals outlet 219 and is configured to be broken prior to use. In some embodiments, closure 300 can be a dispenser configured to seal outlet 219 and dispense liquid disposed in interior volume 218. For example, closure 300 can be a dispenser (e.g., a tap-style dispenser) having a valve configured to open to dispense liquid and close to seal outlet 219.

In some embodiments, closure 300 can include side wall 302, for example, surrounding neck 216, and/or a flange 304. Closure 300 can couple to body 200 at neck 216. For example, closure 300 can include side wall 302 that couples to neck 216 and flange 304 that contacts front wall 205 of body 200. In some embodiments, side wall 302 of closure 300 includes internal threads 310 that couple with external threads 217 of neck 216. In some embodiments, closure 300 is coupled to body 200 by interference fit. In some embodiments, closure 300 is removably coupled to neck 216.

In some embodiments, container 100 can be compatible with a docking station having a dispenser. In some embodiments, when container 100 is compatible with a docking station, closure 300 can be a seal that seals outlet 219 and that is broken, opened, or removed when container 100 is used with the docking station. The docking station can include, for example, a dispensing mechanism (e.g., a tap-style dispenser) configured to dispense liquid stored in interior volume 218 when container 100 is used with the docking station.

In some embodiments, container 100 can be a standalone container for dispensing liquid stored in interior volume 218. In some embodiments, closure 300 includes a dispenser through which liquid in interior volume 218 can be dispensed. For example, as illustrated in FIG. 4, closure 300 can include side wall 302, flange 304, spout 306, and/or dispenser actuator 308. In some embodiments, closure 300 includes a valve (e.g., disposed within closure 300). In some embodiments, the valve can include plunger 312 (see e.g., FIG. 6) that is configured to move from a closed position to an open position in response to a force applied to dispenser actuator 308. For example, in response to a downward force applied to dispenser actuator 308, plunger 312 can move downward from a closed position to an open position to expose a flow path through which liquid can be dispensed from interior volume 218 through spout 306.

In some embodiments, container 100 includes overcap 400 illustrated, for example, in FIGS. 1-4 and 7A. Overcap 400 can include first end 402 and second end 404. In some embodiments, first end 402 can include recess 403 defined by side wall 408. Recess 403 can at least partially cover closure 300 when overcap 400 is coupled to closure 300. In some embodiments, side wall 408 of overcap 400 can include outer surface 410 and inner surface 412. When overcap 400 at least partially covers closure 300, inner surface 412 can contact side wall 302 and rim 406 can contact flange 304. In some embodiments, overcap 400 can be removably coupled to closure 300. In some embodiments, first end 402 can couple to closure 300 by interference fit. In some embodiments, first end 402 includes threads on inner surface 412 that couple with outer threads on closure 300. In some embodiments, first end 402 can include ledge 414, upper side wall 416, and/or upper ledge 418. In some embodiments, side wall 408, shield 420, and/or piercer 428 of overcap 400 are coaxial.

In some embodiments, closure 300 is integral with overcap 400. For example, recess 403 can include closure 300 such that first end 402 of overcap 400 couples directly to neck 216 to seal body 200. In some embodiments, when closure 300 is integral with overcap 400, closure 300 can couple to body 200 by internal threads 310 and external threads 217 or by interference fit, as described above.

In some embodiments, overcap 400 can have a first diameter 450 defined by side wall 408 and a second diameter 451 defined by upper side wall 416. In some embodiments, first diameter 450 is greater than second diameter 451. In some embodiments, first diameter 450 can be about 30 mm to about 60 mm (e.g., about 40 mm to about 50 mm). In some embodiments, first diameter 450 is about 45 mm. In some embodiments, second diameter can be about 15 mm to about 45 mm (e.g., about 25 mm to about 35 mm). In some embodiments, second diameter 450 is about 30 mm.

Figure 3A:
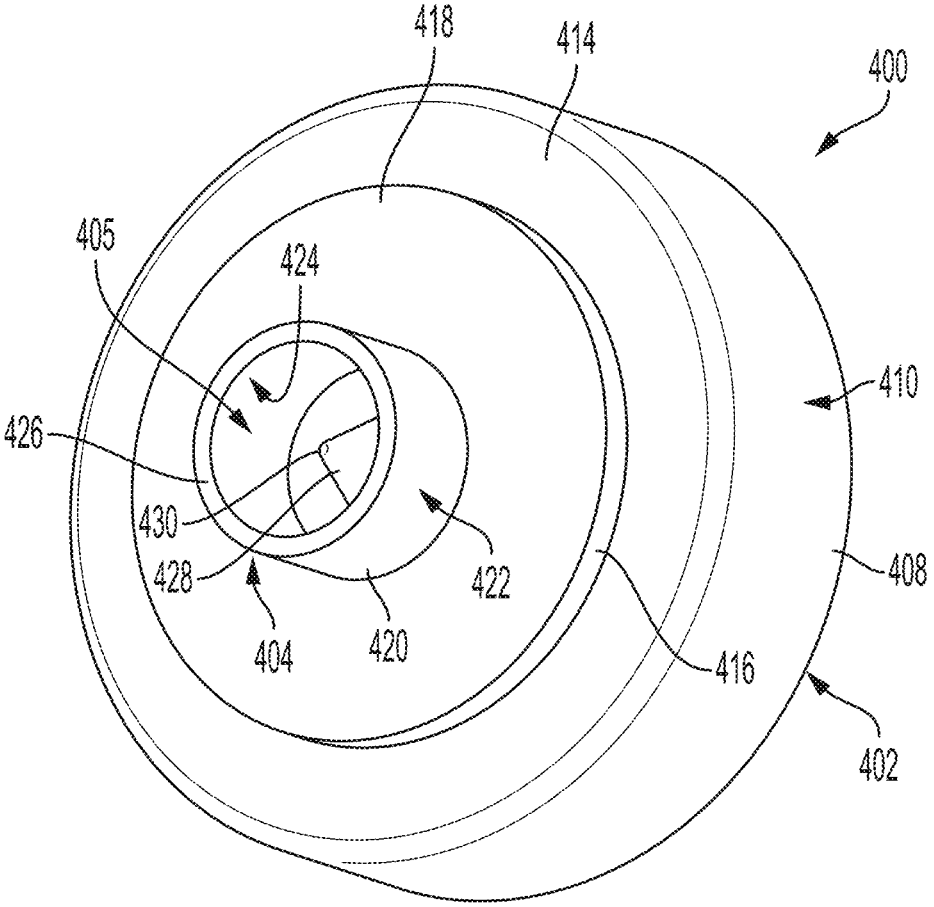
FIGS. 3A-3C show overcaps according to some embodiments.
Figure 3B:
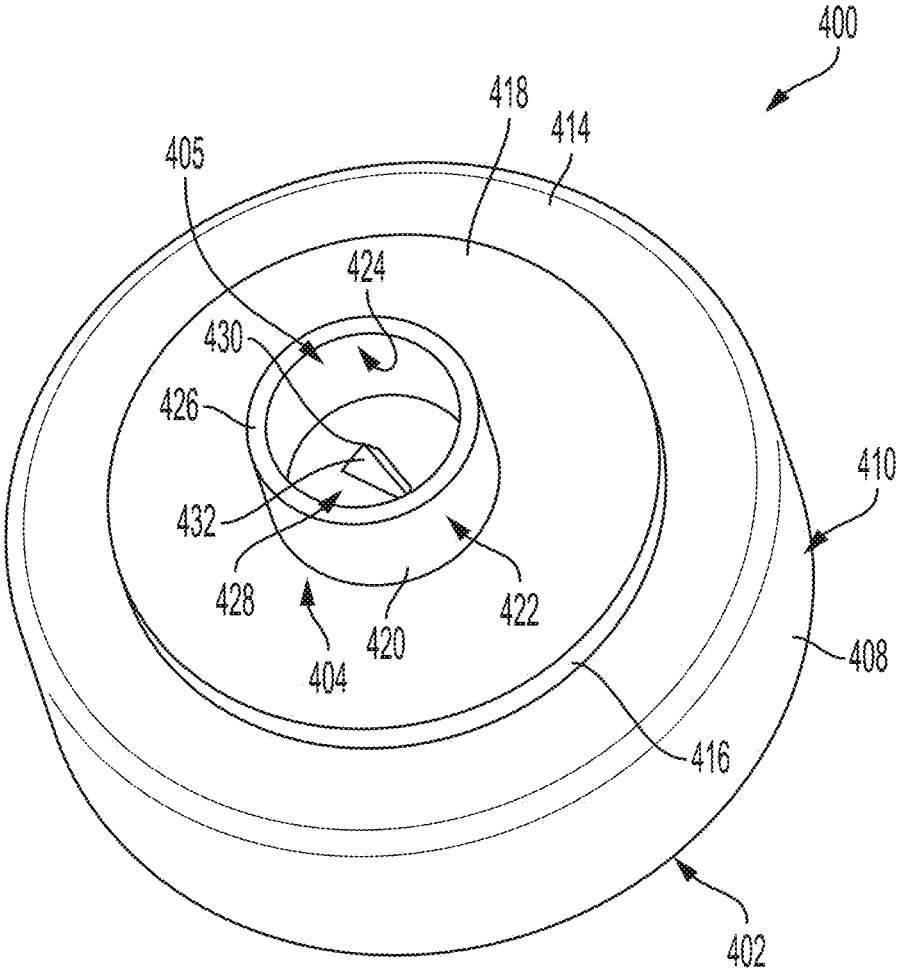
Figure 3C:
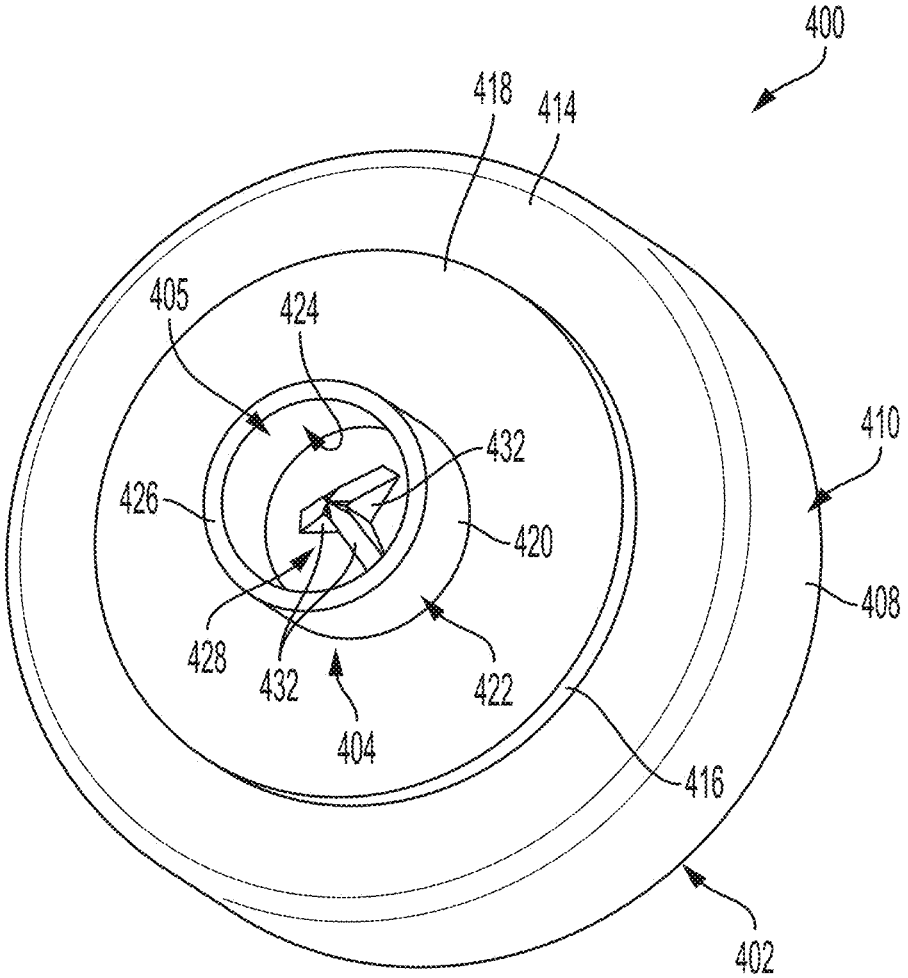

In some embodiments, second end 404 of overcap 400 can include recess 405 defined by shield 420. In some embodiments, shield 420 can include outer surface 422 and inner surface 424. In some embodiments, shield 420 can surround piercer 428. Shield 420 can be inserted in channel 206 so as to guide piercer 428 to the appropriate position relative to protrusion 208. Shield 420 can also prevent a user from accidentally contacting piercer 428 against something other than protrusion 208. In some embodiments, piercer 428 can have pointed tip 430. In some embodiments, piercer 428 can be any suitable sharp projection (e.g., a spike) or a plurality of sharp projections. For example, piercer 428 can have a conical shape or a cylindrical shape with a pointed end. In some embodiments, piercer 428 can have a conical shape, for example, as shown in FIGS. 3A and 7A. In some embodiments, piercer 428 can include two or more conical shapes, each having a pointed tip 430. In some embodiments, piercer 428 includes two or more spokes 432 that together form pointed tip 430 (e.g., as shown in FIG. 3C). In some embodiments, piercer 428 includes at least one blade-like planar structure 432 that forms pointed tip 430. In some embodiments, as shown in FIG. 3B, piercer 428 includes one planar structure 432 shaped like a triangle (or triangular pyramid) that forms pointed tip 430. In some embodiments, as shown in FIG. 3C, piercer 428 includes three planar structures 432 shaped like triangles (or triangular pyramids) that together form pointed tip 430.

In some embodiments, piercer 428 can have a base diameter 453 of about 2 mm to about 8 mm (e.g., about 4 mm to about 6 mm). In some embodiments, base diameter 453 is about 5 mm. In some embodiments, shield 420 can have a height 454 that is greater than a height 455 of piercer 428. In some embodiments, shield 420 can have a height 454 of about 5 mm to about 10 mm (e.g., about 6 mm to about 8 mm). In some embodiments, shield 420 has a height 454 of about 7.5 mm. In some embodiments, shield 420 can have a diameter 452 of about 5 mm to about 20 mm (e.g., about 10 mm to about 15 mm). In some embodiments, shield 420 has a diameter 452 of about 11.5 mm. In some embodiments, piercer 428 can have a height 455 of about 2 mm to about 8 mm (e.g., about 4 mm to about 6 mm). In some embodiments, piercer 428 has a height 455 of about 5 mm.

Shield 420 can be inserted into channel 206 to pierce protrusion 208. For example, when shield 420 is aligned with channel 206, tip 430 of piercer 428 can align with protrusion 208. When a force is applied to overcap 400 toward body 200, tip 430 can pierce protrusion 208, as shown for example in FIG. 7A. After piercing, overcap 400 can be removed to expose vent opening 220, as shown for example in FIG. 7B. Vent opening 220 is large enough to allow air to pass through vent opening 220 into body 200 of container 100 to accommodate changes in pressure related to dispensing liquid, but small enough to inhibit refilling of body 200. This may inhibit use of counterfeit or incompatible liquids with container 100. In some embodiments, vent opening 220 can have a diameter of about 2 mm to about 10 mm (e.g., about 3 mm to about 8 mm or about 3.5 mm to about 5.5 mm). In some embodiments, vent opening 220 has a diameter of about 4 mm.

Figure 5:
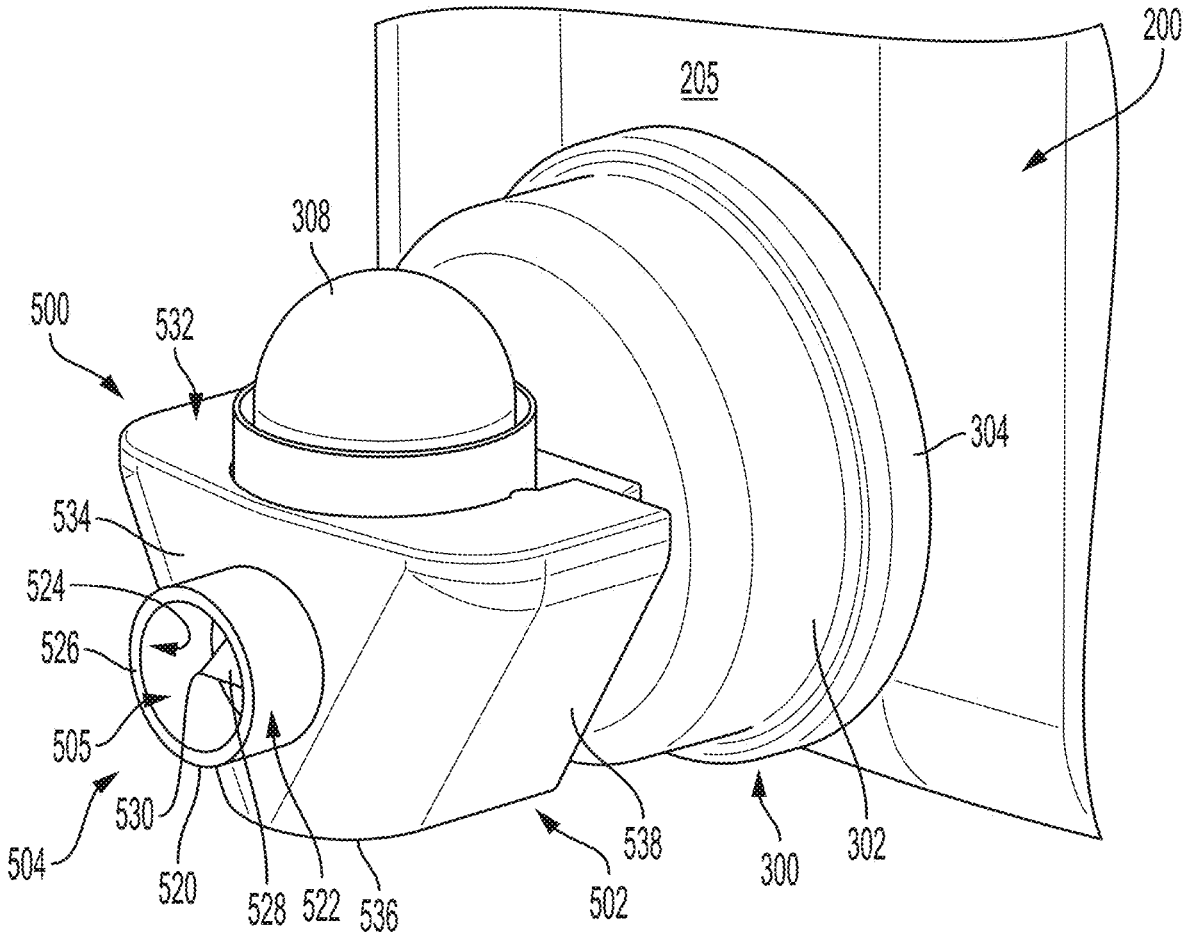
FIG. 5 shows an overcap according to some embodiments.
Figure 6:
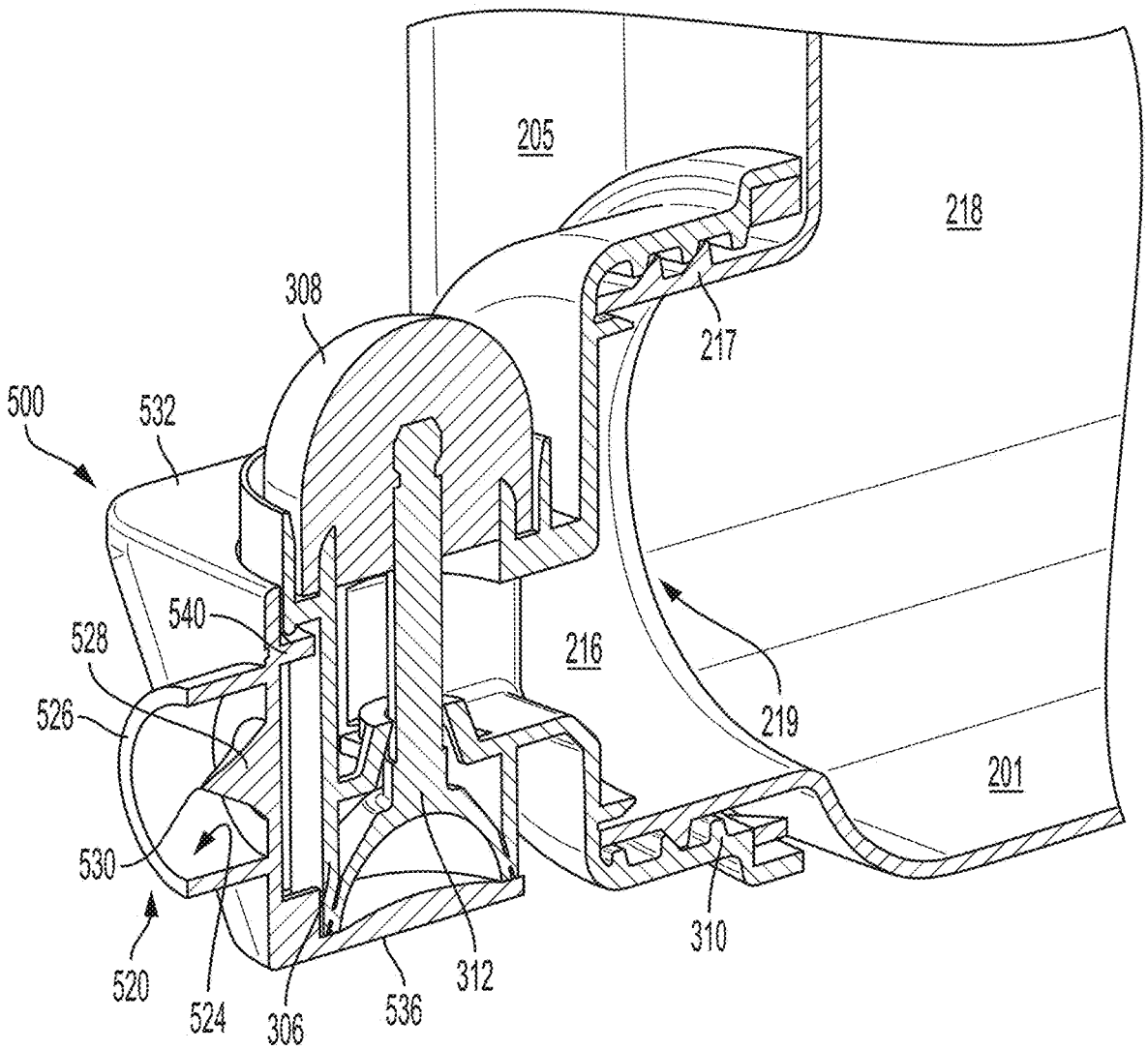
FIG. 6 shows a cross-section of the overcap of FIG. 5

In some embodiments, container 100 includes overcap 500 illustrated, for example, in FIGS. 5 and 6. In some embodiments, overcap 500 is compatible with closure 300 having a tap structure, such as closure 300 shown in FIGS. 4-6. Overcap 500 can include first end 502 and second end 504. In some embodiments, first end 502 can include upper ledge 532, front wall 534, base 536, and side walls 538. As shown in FIG. 6, overcap 500 can include lower ledge 540. In some embodiments, upper ledge 532 and lower ledge 540 can at least partially surround closure 300 and couple to closure 300 (e.g., by interference fit). In some embodiments, base 536 of overcap 500 can cover the bottom of spout 306. When base 536 covers spout 306, as shown in FIGS. 5 and 6, plunger 312 can be prevented from moving. Thus, overcap 500 serves to lock closure 300 before use. In some embodiments, plunger 312 is movable only after overcap 500 has been removed.

In some embodiments, overcap 500 includes a second end 504 that is the same or substantially the same as second end 404 of overcap 400 described above. Corresponding features are indicated with corresponding numbers (e.g., overcap 400 and 500, shield 420 and 520, and piercer 428 and 528). Thus, those skilled in the art would understand that the description above regarding second end 404 of overcap 400 also applies to second end 504 of overcap 500. For example, overcap 500 can include second end 504, recess 505, shield 520, outer surface 522, inner surface 524, rim 526, piercer 528, and/or tip 530. In some embodiments, second end 504 can have the same dimensions as second end 404 described above. Second end 504 can pierce protrusion 208 in the same way that second end 404 pierces protrusion 208 (e.g., as shown in FIGS. 7A and 7B and described above).

Figure 10:
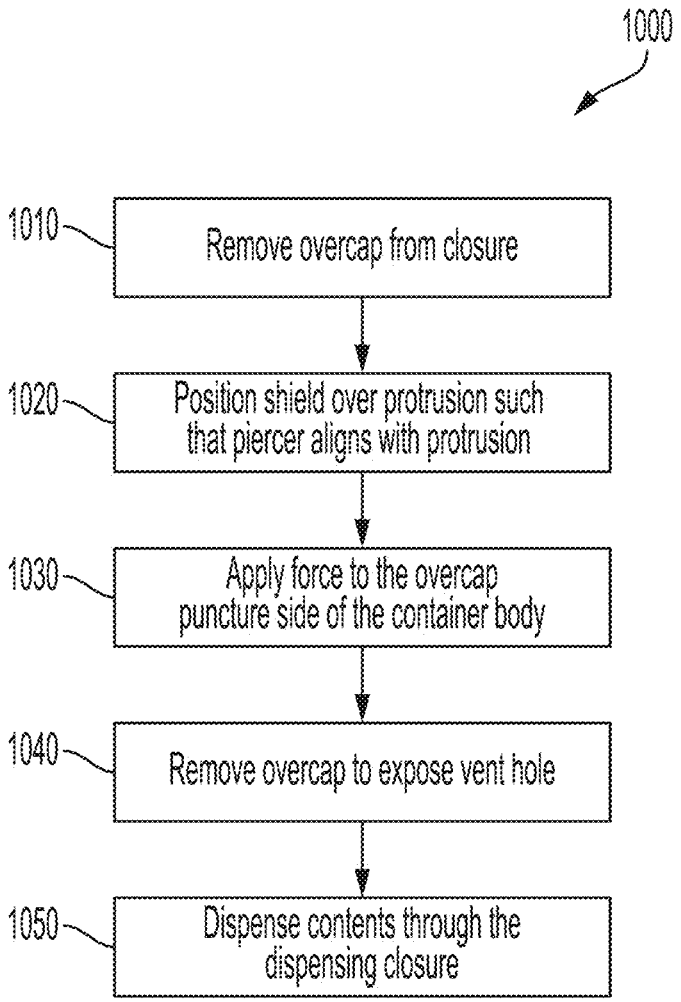
FIG. 10 shows a method for using containers according to some embodiments.

Container 100 can be produced by various methods. For example, body 200 can be made by a blow mold process. In some embodiments, body 200 is a blow molded body. Other components (e.g., closure 300 and overcap 400) can be made by injection molding. Components of container 100 can be produced using various materials, such as one or more plastics (e.g., polyethylene terephthalate (PET) or high density polyethylene (HDPE)). In some embodiments, all components of container 100 are made of the same material such that the entire container can be recycled in a single recycling stream. In some embodiments, all components of container 100 are made of HDPE. Container 100 can be used to dispense liquid stored in interior volume 218 of body 200. FIG. 10 illustrates a flow chart of an example process 1000 for using container 100. At step 1010, overcap 400 (or 500) can be removed from closure 300. This can expose closure 300 (e.g., seal or dispenser). At step 1020, shield 420 (or 520) can be placed over protrusion 208 of body 200 such that piercer 428 (or 528) aligns with protrusion 208. At step 1030, a force can be applied in a direction toward body 200 such that piercer 428 (or 528) pierces protrusion 208. At step 1040, overcap 400 (or 500) can be removed to exposed vent opening 220 in protrusion 208. At step 850, liquid can be dispensed from interior volume 218 through closure 300 (e.g., through spout 306).

As used herein, the terms "upper" and "lower," "top" and "bottom," "front" and "back," "inner" and "outer," and the like are intended to assist in understanding of embodiments of the disclosure with reference to the accompanying drawings with respect to the orientation of the closure as shown, and are not intended to be limiting to the scope of the disclosure or to limit the disclosure scope to the embodiments depicted in the Figures. The directional terms are used for convenience of description and it is understood that embodiments disclosed herein can be positioned in any of various orientations.

The term "about" or "substantially" or "approximately" as used herein refer to a considerable degree or extent. When used in conjunction with, for example, an event, circumstance, characteristic, or property, the term "about" or "substantially" or "approximately" can indicate a value of a given quantity that varies within, for example, 1-15% of the value (e.g., ±1%, ±2%, ±5%, ±10%, or ±15% of the value), such as accounting for typical tolerance levels or variability of the embodiments described herein.

It is to be appreciated that the Detailed Description section, and not any other section, is intended to be used to interpret the claims. Other sections may set forth one or more but not all embodiments of the present disclosure as contemplated by the inventor(s), and thus, are not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The above examples are illustrative, but not limiting, of the present disclosure. Other suitable modifications and adaptations of the variety of conditions and parameters normally encountered in the field, and which would be apparent to those skilled in the art, are within the spirit and scope of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The breadth and scope of the present disclosure should not be limited by any of the above-described embodiments, but should be defined only in accordance with the claims and their equivalents.

What is claimed is:

1. A container for dispensing a liquid, the container comprising:

a body comprising:

an interior storage volume, a neck finish disposed on a first wall of the body, the neck finish defining an outlet through the first wall for dispensing the liquid, and a protrusion formed on a second wall of the body;

a closure for sealing the outlet, the closure coupled to the neck finish; and an overcap removably coupled to the closure, the overcap comprising:

a first end comprising a recess configured to receive a portion of the closure when the overcap is coupled to the closure, a second end opposite the first end, the second end comprising a shield defining a shield recess and a piercer disposed within the shield recess, wherein the shield is configured to at least partially surround the protrusion of the body such that the piercer pierces the protrusion to create a vent opening when the shield at least partially surrounds the protrusion.

2. The container of claim 1, wherein the closure is a dispenser comprising a valve, the dispenser configured to dispense the liquid.

3. The container of claim 1, further comprising a recess in the second wall of the body, the recess defining a channel and the protrusion.

4. The container of claim 3, wherein the neck finish is disposed proximate to a bottom of the body, and wherein the recess is disposed proximate to a top of the body.

5. The container of claim 1, wherein the vent opening has a diameter of 2.0 mm to 10 mm.

6. The container of claim 1, wherein the overcap is integral with the closure.

7. The container of claim 1, wherein the overcap is configured to couple to the closure by an interference fit.

8. The container of claim 1, wherein the first end of the cap has a first diameter and the second end of the cap has a second diameter that is smaller than the first diameter.

9. The container of claim 8, wherein the first diameter is between 40 mm and 50 mm and the second diameter is between 10 mm and 15 mm.

10. The container of claim 1, wherein the piercer has a pointed end.

11. The container of claim 10, wherein the piercer has a conical shape.

12. The container of claim 1, wherein the shield has a first height and the piercer has a second height that is less than the first height.

13. The container of claim 1, wherein the piercer is configured to pierce the protrusion when the shield at least partially surrounds the protrusion and a force is applied to the overcap in a direction normal to the second wall.

14. The container of claim 1, wherein the interior storage volume has a capacity of at least 0.2 liters to 4 liters.

15. The container of claim 1, wherein the container is a blow molded container.

16. The container of claim 1, further comprising the liquid disposed in the interior storage volume.

17. An overcap for venting a container for dispensing a liquid, the overcap comprising:

a first end comprising an outer wall defining a recess, the overcap configured to removably couple to the container at a neck of the container, the neck being disposed at least partially within the recess of the overcap when the overcap is coupled to the container, a second end opposite the first end, the second end comprising a shield defining a shield recess, the shield being configured for insertion into a channel of the container, a piercer disposed within the shield recess, the piercer having a height less than a height of the shield, wherein the piercer is configured to pierce the container when the shield is inserted into the channel to create a vent opening in the container.

18. The overcap of claim 17, wherein the first end is configured to couple to the neck by an interference fit.

19. The overcap of claim 17, wherein the piercer has a conical shape.

20. The container of claim 17, wherein the shield has a first height and the piercer has a second height that is less than the first height.

* * * * *